United States Patent [19]

Joseph et al.

[11] 4,403,620

[45] Sep. 13, 1983

[54] METHOD AND APPARATUS FOR MONITORING THE FUNCTIONING OF TESTING DEVICES IN MACHINES FOR THE PRODUCTION AND/OR PROCESSING OF SMOKERS' PRODUCTS

[75] Inventors: Horst D. Joseph, Hamburg; Friedo Koch, Wohltorf, both of Fed. Rep. of Germany

[73] Assignee: Hauni-Werke Körber & Co. KG, Hamburg, Fed. Rep. of Germany

[21] Appl. No.: 281,327

[22] Filed: Jul. 8, 1981

[30] Foreign Application Priority Data

Jul. 11, 1980 [DE] Fed. Rep. of Germany ..... 3026255

[51] Int. Cl.[3] ..... A24C 5/00

[52] U.S. Cl. ..... 131/280; 131/282; 131/283; 131/907; 131/908; 131/94; 131/95

[58] Field of Search ..... 131/94, 95, 280, 281, 131/282, 283, 96, 905, 908, 907

[56] References Cited

U.S. PATENT DOCUMENTS

| | | | |
|---|---|---|---|
| 2,861,683 | 11/1958 | Gilman | 131/905 |
| 2,937,280 | 5/1960 | Gilman | 131/905 |
| 2,984,352 | 5/1961 | Gilman | 131/905 |
| 3,862,408 | 1/1975 | Boct | 131/905 |

*Primary Examiner*—V. Millin

*Attorney, Agent, or Firm*—Kontler, Grimes & Battersby

[57] ABSTRACT

Filter cigarettes which are produced in a filter tipping machine are conveyed past several successive testing devices, each of which monitors different characteristics of the cigarettes, thereupon past a cigarette removing device, past a segregating device and on to a conveyor for transport of satisfactory cigarettes to a packing machine or into storage. When any one of the testing devices detects a defective or presumably defective cigarette, it generates a defect signal which is transported to the segregating device for expulsion of the respective cigarette from the path which leads to the conveyor. If the operator wishes, the defective or presumably defective cigarettes which are detected by a selected testing device can be conveyed only to and expelled by the removing device in response to the corresponding defect signals so that the removed cigarettes can be examined for the purpose of ascertaining the quality of testing operation which is carried out by the selected testing device. Alternatively, the removing device can be caused to expel a given number of satisfactory cigarettes for examination independently of the testing devices or for other purposes, or at least one pair of successive cigarettes for determination of the quality of imprints on cigarette paper.

36 Claims, 3 Drawing Figures

METHOD AND APPARATUS FOR MONITORING THE FUNCTIONING OF TESTING DEVICES IN MACHINES FOR THE PRODUCTION AND/OR PROCESSING OF SMOKERS' PRODUCTS

BACKGROUND OF THE INVENTION

The present invention relates to a method and apparatus for monitoring the functioning of testing devices in machines or production lines for the making and/or processing of rod-shaped articles which constitute or form part of smokers' products. Such articles may constitute filter cigarettes, cheroots, cigars or cigarillos, plain cigarettes, cheroots, cigars or cigarillos and/or filter rod sections. For the sake of convenience, the following description will refer primarily to filter cigarettes with the understanding, however, that the method and apparatus of the invention can be resorted to with equal advantage in connection with the manufacture and/or processing of other rod-shaped articles which constitute or form part of smokers' products.

In a filter tipping machine, filter cigarettes of unit length or multiple unit length are caused to advance along a predetermined path, normally at right angles to their axes, and past one or more testing devices which ascertain whether or not the filter cigarettes exhibit defects of any one of several types, such as open seams, holes in their wrappers, frayed ends of wrappers, unsatisfactory permeability of selected portions of wrappers (especially wrapers of filter plugs), unsatisfactory density of the tobacco-containing ends, absence of tobacco-containing or filter-containing portions and/or a combination of these. As a rule, cigarettes which are produced in the filter tipping machine travel along a predetermined path and at a predetermined distance from one another, i.e., successive filter cigarettes are separated from each other by spacings or gaps of predetermined width. If a testing device detects a defective or presumably defective filter cigarette (depending upon whether or not the operation of the testing device is reliable), it generates a defect signal which is transported, in imitation of forward movement of the respective filter cigarette, to a segregating station where the defective or presumably defective filter cigarette is ejected from the path so that it cannot reach the consumer. Defect signals can be said to constitute signals of a first type in contrast to signals of a second type (e.g., zero signals or no signals) which are indicative of (presumably) satisfactory or acceptable filter cigarettes. The defect signals must be delayed between a given testing station and the segregating location because, even though a modern filter tipping machine produces very large quantities of filter cigarettes per unit of time, undelayed transmission of a defect signal from a testing device to the location where the defective or presumably defective cigarette is to be expelled from the path would take up only a minute fraction of time that is needed to advance the corresponding filter cigarette from the testing device to the segregating station.

Apparatus of the above outlined type operate quite satisfactorily as long as the testing devices are capable of reliably detecting all filter cigarettes which exhibit the defects that can or should be detected by the respective testing devices. In other words, one must simply assume that the testing devices operate properly and that each filter cigarette which has been found to be defective for one or more reasons must be segregated from the remaining articles downstream of the testing stations and prior to entering that portion of the path from which the filter cigarettes cannot be readily withdrawn for the purpose of preventing defective cigarettes from reaching the consumer.

The path along which the filter cigarettes advance sideways toward, past and beyond the testing station or stations, and along which the satisfactory and defective filter cigarettes advance toward and past the segregating station (and along which the satisfactory filter cigarettes advance beyond the segregating station) can be defined by a variety of conveyors, e.g., by rotary drum-shaped conveyors having axially parallel peripheral flutes for reception of discrete filter cigarettes or of several coaxial rod-shaped articles. As a rule, the distance between successive filter cigarettes which advance toward, past and beyond the testing station or stations and thereupon toward, past and (as far as satisfactory filter cigarettes are concerned) beyond the segregating station is uniform or practically uniform so that it takes a given interval of time for each filter cigarette to advance from its momentary position to the position then occupied by the immediately preceding filter cigarette, and so forth. Since the speed at which the filter cigarettes are transported sideways depends on the machine speed, and the machine speed determines the frequency at which the filter cigarettes are tested at one or more stations and (the defective filter cigarettes) ejected at the segregating station, it can be said that the rate at which the filter cigarettes advance along successive path sections of predetermined length determines the rhythm of operation of the machine or of a production line consisting of a group of interconnected machines for the making and/or processing of rod-shaped articles which constitute or form part of smokers' products.

The criteria or characteristics of filter cigarettes which the various testing devices monitor must be detected with a high degree of accuracy because a filter cigarette is considered defective and must be segregated from other filter cigarettes even if certain of its characteristics deviate rather slightly from the prescribed optimum characteristics. Such criteria or characteristics are monitored by various testing devices which, in the case of filter cigarettes, normally include a device for determination of the presence or absence of open seams, holes, frayed ends and/or like defects in the wrappers of filter cigarettes; a device for detecting the permeability of selected portions of wrappers in order to ascertain whether or not such selected portions can admit requisite quantities of cool atmospheric air into the column of tobacco smoke that flows into a smoker's mouth (the admission of atmospheric air is presumed to reduce the deleterious effects of nicotine and/or condensate upon the health of the smoker); a device for monitoring the density of tobacco-containing ends of filter cigarettes; and a device which monitors the presence or absence of any and all components or constituents of a filter cigarette (especially a device which ascertains the presence or absence of filter plugs). The testing device or devices of or for a filter tipping machine are installed downstream of some or all of the processing stations and such processing stations may include a station for placing pairs of plain cigarettes into axial alignment with one another in such a way that the plain cigarettes define a gap of predetermined width; a station where such gaps receive filter plugs of double unit length; a station where uniting bands are attached to successive groups of coaxial plain cigarettes and filter plugs; a station where the uniting bands are rolled around the respective groups so that each group constitutes a filter cigarette of double unit length; a station where successive filter cigarettes of double unit length are converted into filter cigarettes of unit length; and one or more additional stations.

The testing of various characteristics of filter cigarettes is desirable for a number of reasons. Thus, one can prevent defective filter cigarettes from reaching the consumers. Secondly, by ascertaining some or all of the defects, one can effect manual or automatic adjustments in a sense to eliminate the causes of such defects. Still further, the number of rejects can be held to a minimum if the defects are detected as quickly as possible, i.e., as close to the locus of the cause or causes of malfunctions as possible in view of the nature and mode of operation of a filter tipping machine. Thus, when one or more testing devices generate defect signals which entail a segregation of corresponding filter cigarettes from the satisfactory filter cigarettes, such defect signals can also be used for automatic, semiautomatic or manual regulation of various operations in the region or regions where the causes of malfunction and the resulting defects occur.

Segregation of defective filter cigarettes can take place immediately at or immediately downstream of the testing device which is used to detect defective cigarettes. Thus, if the machine embodies two or more testing devices, defective filter cigarettes can be removed at two or more different locations. This is cumbersome in many instances because the means for gathering defective filter cigarettes occupy a substantial amount of space which is at a premium in all kinds of machines for the manufacture and/or processing of cigarettes, filter rod sections or the like. Therefore, it is preferred to provide a common segregating station for all defective or presumably defective filter cigarettes and to provide means for delaying the defect signals which are generated by various testing devices so that all such signals can be transmitted to a single segregating device which is located downstream of the last or rearmost testing device. A method and an apparatus for the practice of such method with a view to segregate defective filter cigarettes at one and the same station, in spite of the fact that the signals for ejection can be furnished by two or more testing devices are disclosed in German Offenlegungsschrift No. 21 13 841. The apparatus which is disclosed in this prior publication comprises a signal delaying system which receives defect signals from several testing devices and delays each defect signal in dependency on the distance between the segregating station and the respective testing device. For example, the delaying system can employ a shift register with a number of successive stages one of which receives defect signals from a first testing device, another of which receives defect signals from a second testing device, and so forth. This ensures that the interval of travel of a defect signal from any one of several testing devices to the last stage of the delaying system and hence to the segregating station always matches the interval of travel of the corresponding defective filter cigarette from the station where a defect was detected to the segregating station. Such synchronization of transport of defect signals and of the defective filter cigarettes to the segregating station is desirable and necessary in order to ensure that the segregating device will weed out only those filter cigarettes which have been found to be defective or which have been labelled as being defective by one or more testing devices upstream of the segregating station.

A drawback of the just discussed method and apparatus is that it is not possible to associate the segregated filter cigarettes with those testing devices which have caused the segregation of filter cigarettes, i.e., the defective or presumably defective filter cigarettes are segregated at one and the same station but there is no possibility of ascertaining which cigarette was segregated in response to a defect signal from a first testing device, which cigarette was segregated in response to a defect signal from a second testing device, and so forth. On the other hand, such association of segregated filter cigarettes with the corresponding testing devices would be desirable and advantageous because one could readily ascertain whether or not any given testing device operates properly by the simple expedient of gathering a certain number of filter cigarettes which were segregated in response to signals from a given testing device and thereupon subjecting the gathered cigarettes to an independent examination. Thus, one could ascertain whether or not a testing device is properly adjusted so that it invariably segregates or initiates the segregation of all filter cigarettes which exhibit a given defect as well as whether or not such testing device effects the segregation of acceptable cigarettes and/or permits unsatisfactory cigarettes to advance past aand beyond the segregating station.

OBJECTS AND SUMMARY OF THE INVENTION

An object of the invention is to provide a novel and improved method of monitoring two or more different characteristics of rod-shaped articles in a filter tipping or a like machine in such a way that all defective articles can be gathered at a single location but that one can readily ascertain, when necessary, which of the various testing devices has initiated the ejection of such articles.

Another object of the invention is to provide a novel and improved method of indirectly ascertaining the quality of testing in a filter tipping or like machine.

A further object of the invention is to provide a relatively simple method of rapidly associating selected defective or presumably defective articles of a short or long series of randomly distributed defective and satisfactory articles with the testing devices which have initiated the segregation of defective or presumably defective articles from the aforementioned series.

An additional object of the invention is to provide a method which can be practiced to ensure rapid and reliable identification of that testing device which has caused the segregation of a group of articles in response to detection or assumed detection of certain undesirable or unsatisfactory characteristics.

A further object of the invention is to provide a method which can be practiced by resorting to relatively simple, compact and inexpensive apparatus, which can involve automatic or semiautomatic association of segregated articles with any one of several discrete testing devices, and which can be resorted to in connection with the manufacture and/or processing of a variety of rod-shaped articles which constitute or form part of smokers' products.

An additional object of the invention is to provide a method of the above outlined character which can be resorted to for identification or association of any desired number of defective or presumably defective articles with any one of several testing devices and which can be practiced for any desired interval of time while the remaining testing device or devices continue to initiate, at a single location, the segregation of articles exhibiting defects which are to be detected by such remaining testing device or devices.

A further object of the invention is to provide a novel and improved apparatus for the practice of the above outlined method and to construct and assemble the apparatus in such a way that it can rapidly associate segregated defective or presumably defective cigarettes or analogous rod-shaped articles with any one of several testing devices.

An additional object of the invention is to provide a relatively simple, compact and inexpensive apparatus which can be incorporated in or associated with many existing types of machines or production lines for the making and/or processing of cigarettes, filter rod sections or the like.

Another object of the invention is to provide an apparatus which can perform the aforediscussed functions as well as one or more additional desirable functions, such as removing a given number of satisfactorily or presumably satisfactory articles, facilitating determination of the quality of imprints on the wrappers of cigarettes or the like, rapidly switching from separate accumulation of defective articles exhibiting a first type of defects to accumulation of articles which exhibit an entirely different type of defects, and/or any combination of such desirable functions.

A further object of the invention is to provide an apparatus which, in spite of its aforediscussed versatility, is capable of reliably segregating all defective or presumably defective articles in such a way that the gathering and removal of segregated articles take up a minimum of space and can be effected by resort to very simple and inexpensive instrumentalities.

An additional object of the invention is to provide the apparatus with novel and improved means for preventing the device or devices which effect the segregation of defective articles from interfering with separate gathering of articles which exhibit or are assumed to exhibit a certain type of defects.

Another object of the invention is to provide the apparatus with novel and improved means for permitting rapid and simple selection of the number of defective or presumably defective articles which are to be gathered independently of the remaining articles for the purpose of facilitating indirect monitoring of the condition and/or mode of operation of a selected testing device in a filter tipping machine, in a filter rod making machine and/or in a cigarette rod making machine.

One feature of the invention resides in the provision of a method of manipulating rod-shaped articles, preferably articles (such as plain or filter cigarettes, cheroots, cigars or cigarillos or filter rod sections) which constitute or form part of smokers' products. The method comprises the steps of conveying the articles (preferably sideways, i.e., at right angles to their longitudinal axes) in a predetermined direction and along a predetermined path having a plurality of first sections as well as a second and a third section both located downstream of the first sections, subjecting successive articles to a test at each of the first sections including respectively generating signals of first and second types when the articles which are being tested are respectively defective and satisfactory, normally transporting signals of the first type from each of the first sections to the second section in synchronism with the conveying of the respective articles to the second section and utilizing such signals of the first type to segregate the respective (defective or presumably defective) articles from the path at the second section, optionally (i.e., whenever the operator so decides or when determined by a suitable clock or the like) transporting signals of at least one of the first and second types from a selected first path section to the third path section in synchronism with the conveying of the corresponding (satisfactory or defective) articles, and utilizing signals of such one type for removal of the respective articles from the path at the third section. This renders it possible to subject the removed articles to an independent examination in order to ascertain whether or not the test in a selected first path section was satisfactory.

One of the second and third path sections is located downstream of the other of the second and third path sections; for example, the third path section can be located upstream of the second path section so that the articles which are removed for the purpose of independent inspection or for another purpose are withdrawn from the path ahead of the defective or presumably defective articles which are segregated at the second path section.

Signals of the one type may constitute signals of the first type, i.e., the articles which are removed at the third path section are defective or presumably defective articles all of which exhibit or should exhibit the same defect or defects. Alternatively, signals of the one type may constitute signals of the second type, i.e., articles which are withdrawn at the third path section are or should be satisfactory articles. The thus withdrawn articles can be inspected in order to ascertain (e.g., in a laboratory) whether or not they are actually satisfactory.

The method may further comprise the step of optionally removing pairs of successive articles from the path in the region of the third path section. This is desirable and advantageous if the attendants wish to inspect the quality of imprints which can be found on the wrappers of cigarettes or the like.

The removal of articles at the third path section can be terminated automatically after elapse of a predetermined interval of time. Alternatively, the method may further comprise the steps of counting the number of removed articles and terminating such removal when the number of removed articles matches a predetermined number.

As a rule, each article has at least one tubular wrapper, and one of the tests then includes (or may include) monitoring the wrappers for the presence or absence of leaks (such leaks may be due to open seams, frayed ends or holes in the wrappers of plain or filter cigarettes or analogous smokers' products). Each wrapper may include at least one portion which normally exhibits a predetermined permeability; one of the tests then involves (or may involve) monitoring the permeability of such portions of wrappers of successive articles. If the articles are plain or filter tipped cigarettes, cheroots, cigarillos or cigars, one of the tests may include monitoring the density of a tobacco-containing end portion of each article. If the articles are composite articles (e.g., multiplex filter plugs or filter cigarettes each of which has a tobacco-containing component and at least one filter component), at least one of the tests may include monitoring successive articles for the presence or absence of all components.

It is preferred that the distance between any two sections of the path for the articles constitute a whole multiple of a unit distance. For example, two first sections may be located at a unit distance from one another, the distances between such first sections and the second section may respectively equal twenty and twenty-one unit distances, and the distances between such first sections and the third section may respectively equal twelve and thirteen unit distances.

It is preferred to provide a further step of interrupting the step of optionally transporting signals of the one type and/or of removing pairs of successive articles at the will of the operator. In other words, the operator can interrupt the withdrawal of articles at the third section of the path irrespective of the fact that such withdrawal would have been terminated in response to elapse of a preselected interval of time or in response to removal of a preselected number of articles.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
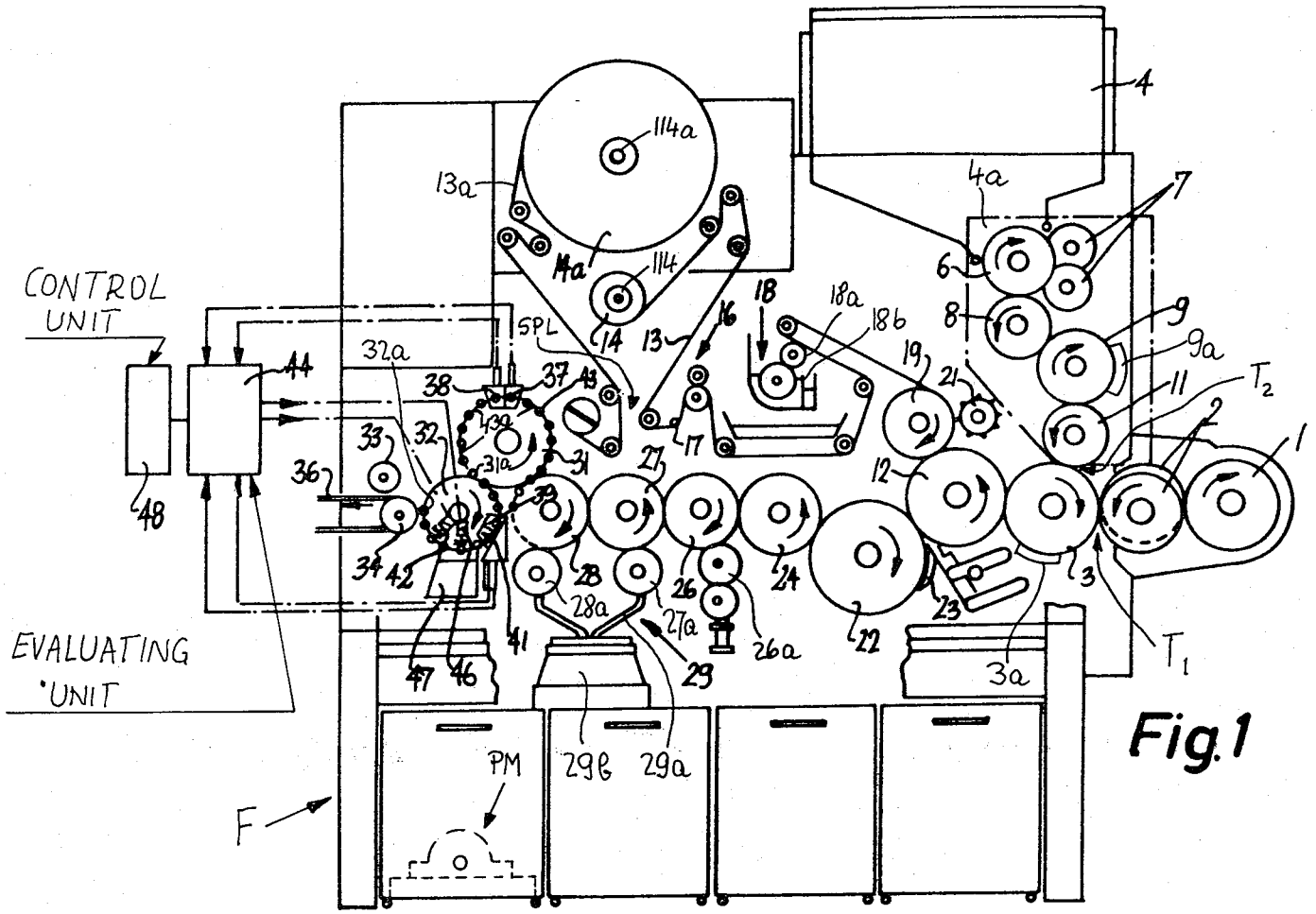
FIG. 1 is a schematic elevational view of a filter tipping machine wherein plain cigarettes are united with filter rod sections to form filter cigarettes and which embodies one form of the improved apparatus.

Referring first to FIG. 1, there is shown a filter tipping machine of the type known as MAX S which is manufactured and sold by the assignee of the present application. The construction of the filter tipping machine, which is directly coupled to a cigarette making machine (for example, a machine known as SE 80 manufactured and sold by the assignee of the present application), is as follows:

The frame F of the filter tipping machine supports a rotary drum-shaped conveyor 1 which can be said to form part of the aforementioned cigarette making machine and delivers two rows of plain cigarettes of unit length to a pair of staggered rotary drum-shaped aligning conveyors 2. The plain cigarettes of one row of cigarettes in the axially parallel peripheral flutes of the row forming conveyor 1 are adjacent to one axial end, and the plain cigarettes of the other row are adjacent to the other axial end of this conveyor. Furthermore, the cigarettes of one row are transported by oddly numbered flutes whereas the cigarettes of the other row are transported by evenly numbered flutes of the conveyor 1. The two rows of cigarettes are transferred into the peripheral flutes of the corresponding aligning conveyors 2 which rotate in a counterclockwise direction, as viewed in FIG. 1, and are driven at different speeds and/or transport the respective cigarettes through different distances so that, when a flute of the front aligning conveyor 2, as viewed in FIG. 1, reaches a transfer station T1, it is an accurate axial alignment with a flute of the rear aligning conveyor 2. Such flutes deliver a pair of coaxial plain cigarettes of unit length into the adjacent flute of a rotary drum-shaped assembly conveyor 3 which is driven to rotate in a clockwise direction, as viewed in FIG. 1.

The top portion of the frame F supports a magazine 4 for a supply of parallel rod-shaped filter rod sections (not specifically shown) of six times unit length. The outlet opening 4*a* at the lower end of the magazine 4 receives a portion of a rotary drum-shaped severing conveyor 6 which is driven to rotate in a clockwise direction, as viewed in FIG. 1, and has peripheral flutes extending in parallelism with its axis. Such flutes remove from the magazine 4 discrete filter rod sections of six times unit length and transport successive filter rod sections past two rotary disc-shaped knives 7 which rotate about parallel axes and are staggered with respect to each other, as considered in the axial direction of the severing conveyor 6. The conveyor 6 cooperates with the knives 7 to convert successive filter rod sections of six times unit length into sets of three coaxial filter plugs of double unit length, and the filter plugs of successive sets are transferred onto a rotary staggering conveyor 8. The conveyor 8 is assembled of three discs which may but need not rotate about a common axis and are driven at different speeds and/or transport the respective filter plugs through different distances so that the filter plugs of each set are staggered with respect to each other, as considered in the circumferential direction of the conveyor 8, prior to transfer of successive filter plugs of double unit length into successive peripheral flutes of a rotary drum-shaped shuffling conveyor 9. The conveyor 9 is driven to rotate in a clockwise direction, as viewed in FIG. 1, and cooperates with two stationary cams 9*a* (only one shown) to convert the single row of axially staggered filter plugs into a row wherein each preceding filter plug is in accurate alignment with the next-following plug prior to transfer of successive plugs of the thus obtained row into successive flutes of a combined accelerating and inserting conveyor 11. The conveyor 11 is a rotary drum whose flutes deliver filter plugs of double unit length into successive flutes of the assembly conveyor 3 at a second transfer station $T_2$ which is located upstream of the transfer station $T_1$. The pairs of plain cigarettes of unit length which are delivered into the flutes of the assembly conveyor 3 at the transfer station $T_1$ are spaced apart from each other by a distance which at least equals the axial length of a filter plug of double unit length, and the inserting conveyor 11 delivers filter plugs into successive flutes at the station $T_2$ in such positions that, upon arrival at the transfer station $T_1$, the filter plugs are located in the gaps between the corresponding plain cigarettes of unit length. The assembly conveyor 3 advances the thus obtained groups of three coaxial rod-shaped articles each through the space between two suitably configurated condensing cams 3*a* (only one shown) which cause the plain cigarettes to move axially toward each other and into abutment with the respective end faces of the corresponding filter plug of double unit length.

The assembly conveyor 3 delivers successive condensed groups (each such group contains two coaxial plain cigarettes of unit length and a filter plug of double unit length therebetween) into successive flutes of a rotary drum-shaped transfer conveyor 12. This conveyor further receives adhesive-coated uniting bands from a rotary drum-shaped suction conveyor 19 which cooperates with the blades of a rotary cutter 21.

The uniting bands are obtained in response to severing of the leader of a continuous web 13 of cigarette paper, imitation cork or another suitable flexible strip-shaped wrapping material (also called tipping paper). Such material is drawn off a reel 14 which is mounted on a spindle 114 and is caused to travel around a plurality of guide rolls prior to reaching a so-called curling device 17 of the type disclosed in commonly owned U.S. Pat. No. 3,962,957 granted June 15, 1976 to Alfred Hinzmann. After advancing beyond the curling device 17, successive increments of the web 13 enter the nip of two advancing rolls 16 at least one of which is driven to advance the web in a direction toward the suction conveyor 19. The leader of the web 13 adheres to the foraminous peripheral surface of the suction conveyor 19 and is caused to advance past successive blades of the rotating cutter 21. The latter cooperates with the conveyor 19 to convert the web 13 into a series of discrete web portions or uniting bands of predetermined length. The conveyor 19 draws the web 13 from the advancing rolls 16 and transports the web along a paster 18 which coats one side of the web 13 with a suitable adhesive. The rotary applicator 18*a* of the paster 18 receives adhesive from a source of supply here shown as a tank 18*b* and coats a portion of or the entire underside of the travelling web 13.

The conveyor 19 applies successive discrete uniting bands to successive groups of coaxial rod-shaped articles in the oncoming flutes of the transfer conveyor 12. The uniting bands are preferably applied in such a way that they are disposed substantially tangentially of the respective groups and adhere to the corresponding filter plugs as well as to the innermost portions of the respective plain cigarettes of unit length. Such groups, each of which carries an adhesive-coated uniting band, are thereupon transferred onto the peripheral surface of a rotary drum-shaped wrapping conveyor 22 which cooperates with an adjustable (stationary or mobile) rolling device 23 to convolute the oncoming uniting bands around the respective groups so that each group constitutes a filter cigarette of double unit length.

The wrapping conveyor 22 delivers successive filter cigarettes of double unit length into successive flutes of a rotary drum-shaped drying conveyor 24 which can embody or is associated with suitable testing means for detection of filter cigarettes having defective wrappers. At least those filter cigarettes of double unit length whose wrappers are satisfactory are thereupon delivered into successive flutes of a rotary drum-shaped severing conveyor 26 which cooperates with a rotary disk-shaped knife 26*a* to sever each filter cigarette of double unit length midway across its filter plug so that each such cigarette yields two coaxial filter cigarettes 43 of unit length. Each filter cigarette 43 of unit length contains a plain cigarette of unit length, a filter plug of unit length, and one-half of a convoluted tubular uniting band which binds the filter plug to the respective plain cigarette.

The severing conveyor 26 delivers successive pairs of filter cigarettes 43 of unit length into successive flutes of a rotary drum-shaped conveyor 27 of a turn-around device 29 of the type disclosed in commonly owned U.S. Pat. No. 3,583,546 granted to Gerhard Koop. The turn-around device 29 further comprises a second rotary drum-shaped fluted conveyor 27*a* which receives one filter cigarette 43 of each pair from the conveyor 27, a third rotary drum-shaped fluted conveyor 28 which receives the other filter cigarette 43 of each pair from the conveyor 27, a fourth rotary drum-shaped fluted conveyor 28*a*, and a set of orbiting arms 29*a* which receive motion from a driving unit 29*b*.

The operation of the turn-around device 29 is as follows: The conveyor 27 receives pairs of coaxial filter cigarettes 43 of unit length from successive flutes of the severing conveyor 26. One filter cigarette 43 of each pair is delivered into the oncoming flute of the conveyor 28, whereas the other filter cigarette 43 of each pair enters the oncoming flute of the conveyor 27*a*. Successive flutes of the conveyor 27*a* deliver the respective filter cigarettes 43 of unit length to oncoming arms 29*a* which turn each filter cigarette 43 end-for-end and deliver the inverted cigarettes into successive flutes of the conveyor 28*a*. The conveyor 28*a* delivers the inverted filter cigarettes 43 of unit length into alternate flutes of the conveyor 28. It is to be noted that the conveyor 27 delivers successive non-inverted filter cigarettes 43 of unit length into alternate flutes of the conveyor 28 so that the latter provides room for acceptance of inverted cigarettes 43 from the conveyor 28*a*. The arrangement is preferably such that the conveyor 28*a* delivers inverted filter cigarettes 43 of unit length into the spaces between successive pairs of non-inverted cigarettes 43 on the conveyor 28. Thus, the conveyor 28 transports a single file of aligned filter cigarettes 43 of unit length in a clockwise direction, as viewed in FIG. 1, and the filter plugs of all filter cigarettes 43 on the conveyor 28 face in the same direction. Successive flutes of the conveyor 28 deliver successive filter cigarettes of unit length to a testing conveyor 31, for example, a conveyor of the type disclosed in commonly owned U.S. Pat. No. 3,962,906 granted June 15, 1976 to Uwe Heitmann et al. The cigarettes 43 which are defective are segregated from satisfactory cigarettes on a rotary drum-shaped conveyor 32 which follows the testing conveyor 31 and may cooperate with one or more additional testing devices one of which monitors the tobacco-containing ends of successive cigarettes. The cigarettes 43 which are found to be defective by the testing devices 37, 38 next to the conveyor 31 and/or by the testing devices 39, 41 next to the conveyor 32 are segregated during travel past a signal responsive segregating device including a valve 42, and the remaining (satisfactory) cigarettes 43 of unit length are delivered onto the upper reach of an endless belt conveyor 36. The upper reach of the conveyor 36 cooperates with a braking roll 33 and this conveyor is trained over pulleys 34 of which only one is shown in FIG. 1. The upper reach of the conveyor 36 delivers satisfactory filter cigarettes 43 of unit length into storage, directly to a packing machine, or into a reservoir system (e.g., a system of the type which is known as Resy and is manufactured and sold by the assignee of the present application).

The operation of the wrapping conveyor 22 and rolling device 23 will be understood upon perusal of the disclosure in commonly owned U.S. Pat. No. 3,483,873 or No. 3,527,234, both granted to Alfred Hinzmann.

The frame F further supports a spindle 114*a* for a fresh reel 14*a* of wrapping material 13*a* the leader of which is held at a splicing station SPL. When the supply of running web 13 on the reel 14 is nearly exhausted, a splicing device (not specifically shown) at the station SPL is actuated to attach the leader of the web 13*a* to the trailing portion of the web 13. A splicing device which can be used in the filter tipping machine of FIG. 1 is disclosed, for example, in commonly owned U.S. Pat. No. 3,730,811 granted May 1, 1973 to Hans-Joachim Wendt. The disclosures of all of the aforementioned commonly owned patents and of the patents to be referred to hereinafter are incorporated herein by reference.

The driven parts of the filter tipping machine receive motion from a main prime mover PM, e.g., a variable speed electric motor which can rotate the advancing rolls 16 and the suction conveyor 19 (i.e., the means for transporting the web 13 along an elongated path extending from the reel 14 to the transfer conveyor 12, namely, to the path for the groups of rod-shaped articles) at a plurality of different speeds.

The testing conveyor 31 carries or cooperates with the aforementioned testing devices 37 and 38 the first of which ascertains the presence or absence of leaks in the wrappers of successive filter cigarettes 43 of unit length and the second of which ascertains the permeability of selected portions of such wrappers. A testing device which monitors the wrappers for the presence or absence of leaks in the form of open seams, holes, frayed ends and the like is disclosed, for example, in the aforementioned commonly owned U.S. Pat. No. 3,962,906 to Heitmann et al. A testing device which can ascertain the permeability of selected portions of wrappers of filter cigarettes or the like is disclosed in commonly owned U.S. Pat. No. 4,177,670 granted Dec. 11, 1979 to Uwe Heitmann et al.

The two additional testing devices 39 and 41 are adjacent to the conveyor 32. The device 39 tests the heads or free ends of tobacco-containing portions of filter cigarettes 43, and the device 41 monitors the filter cigarettes 43 for the presence or absence of filter plugs. Commonly owned U.S. Pat. No. 3,412,856 granted Nov. 26, 1968 to Albert Esenwein discloses an apparatus which can test the ends of filter cigarettes in order to ascertain whether or not the density of such ends is within an acceptable range. A testing device which ascertains the presence or absence of filter plugs can comprise a battery of photocells or analogous detectors which scan the path portion along which the articles 43 advance with the conveyor 32 and generate signals when the length of the article passing therealong is insufficient, i.e., when such length is indicative of a rod-shaped article which is shorter than a satisfactory filter cigarette 43.

The exact details of the conveyors 31, 32 and of the four testing devices 37, 38, 39 and 41 form no part of the present invention. It suffices to say that the system of the present invention can utilize any suitable testing devices which are capable of generating signals denoting acceptable or unsatisfactory parameters of the tested articles, such as the integrity or lack of integrity of the wrappers, the extent of permeability of selected portions of the wrappers (especially those portions which are provided with intentionally formed holes or perforations in order to allow requisite quantities of cool atmospheric air to enter the column of tobacco smoke), the presence or absence of all components of a composite rod-shaped smokers' product (i.e., the presence or absence of the filter plug or of the tobacco-containing part of a filter cigarette), and/or the density of one or more selected portions of a cigarette (especially the density of the tobacco-containing end of a filter cigarette).

The conveyor 32 further comprises or cooperates with the valve 42 which has or is connected to a nozzle with one or more orifices serving to discharge one or more jets of a suitable gaseous fluid (normally air) to expel a selected article 43 from its path, i.e., to segregate such selected article from the path for satisfactory articles. Reference may be had to the aforementioned U.S. Pat. No. 4,177,670 which describes and shows a valve (e.g., the valve 104 in FIG. 4) cooperating with a nozzle (such as 107) and connected with a source of pressurized gaseous fluid (such as 106) to effect segregation of certain articles in response to signals from an evaluating circuit (by way of the amplifier 103 shown in FIG. 4 of said Letters Patent). The valve 42 is actuated when a defective or potentially defective or even non-defective article 43 is in register with the nozzle whereby the jet or jets of pressurized fluid which issue from the orifice or orifices of the nozzle in response to temporary opening of the normally closed valve 42 effect segregation of such article from the path for satisfactory articles. The receptacle which collects articles 43 that leave their path in response to opening of the valve 42 is not shown in the drawing.

FIG. 1 further shows that the path for the articles 43 between the rearmost testing device 37 and the locus of the valve 42 consists of a series of successive path sections or portions 43*a* of predetermined length. The articles 43 travel sideways, i.e., their axes are normal to the direction of their movement along the peripheries of the drum-shaped conveyors 31 and 32. These conveyors have peripheral flutes 31*a* and 32*a*, and the distance between the centers of neighboring flutes 31*a* or 32*a* determines the length of the path sections 43*a*. Each of the testing devices 37, 38, 39, 41 is separated from the valve 42 by a predetermined first distance which equals a predetermined number of sections 43*a*, e.g., m sections 43*a* between the testing device 37 and the valve 42, n sections 43*a* between the testing device 38 and the valve 42, p sections 43*a* between the testing device 39 and the valve 42, and r sections 43*a* between the testing device 41 and the valve 42. Each of the characters m, n, p and r denotes a whole number.

If the testing device 37 detects a defect in an article 43 in the adjacent (first) path section 43*a*, it generates a defect signal (first signal) which must be transmitted to the valve 42 with a given delay, namely, a delay which corresponds to the interval of travel of the freshly detected defective article 43 from the testing device 37 to the valve 42. It is immaterial whether the defect signal is delayed in the region of the testing device 37, in the region of the valve 42 or anywhere between the device 37 and valve 42; all that counts is to ensure that such defect signal will initiate activation (opening) of the valve 42 at the exact moment when the article 43 which has caused the generation of such defect signal is in exact register with the orifice or orifices of the nozzle controlled by the valve 42. The same holds true for the defect signals which are generated by the other three testing devices 38, 39 and 41, i.e., each such defect signal must be delyaed for a different interval of time to thereby ensure that the defect signals will invariably initiate the segregation of those rod-shaped articles 43 whose testing has resulted in the generation of respective defect signals or first signals. A defect signal which has been generated by the testing device 38 must be delayed for an interval which is shorter than the interval of delaying a defect signal from the testing device 37, a defect signal from the testing device 39 is delayed for an interval of time which is shorter than the interval of delaying a defect signal from the testing device 38, and a defect signal from the testing device 41 will be delayed for an even shorter interval of time because the device 41 is nearest to the valve 42.

The means for effecting requisite delays in transmission of defect signals to the valve 42 includes an evaluating circuit 44 which is connected with the testing devices 37, 38, 39 and 41 to receive defect signals therefrom and which is further connected with the valve 42 to transmit properly delayed signals for opening of this valve at the exact moment when a defective article 43 is in register with the segregating means. Thus, the circuit 44 can ensure that the valve 42 segregates any and all defective articles 43 irrespective of whether the defect has been ascertained by the testing device 37, 38, 39 or 41.

In accordance with a feature of the invention, the apparatus comprises a signal responsive article segregating or removing device 46 which is adjacent to or mounted in or on the conveyor 32 and is disposed at a different predetermined distance from each of the four testing devices, 37, 38, 39 and 41. In the embodiment which is shown in FIG. 1, the removing device 46 is located upstream of the valve 42 of the segregating device, i.e., nearer to the testing devices 37, 38, 39 and 41. The removing device 46 is also connected with the evaluating circuit 44 and is disposed at a level above a collecting or intercepting receptacle 47 for those rod-shaped articles 43 which are expelled from the path by the removing device 46.

The evaluating circuit 44 is connected with a control unit 48 having numerous controls (in the form of push-buttons, pivotable switches and/or like control elements) which effect necessary adjustments of the evaluating circuit 44 so that the latter can initiate removal or expulsion (into the receptacle 47) of articles 43 which have been tested and found to be defective or satisfactory by the testing device 37, 38, 39 or 41. The provision of removing device 46, in combination with the control unit 48 for the evaluating circuit 44, renders it possible to monitor the operation of a selected testing device, i.e., to ascertain whether or not the selected testing device functions properly or is defective. For example, let it be assumed that the person in charge wishes to monitor the operation of the testing device 37. The attendant in charge then actuates one or more control elements of the control unit 48 so as to set the evaluating circuit 44 for activation of the removing device 46 in response to generation of defect signals by the testing device 37. This means that all such articles 43 which have been found to be defective during travel past the testing device 37 are removed at 46 (into the receptacle 47) rather than at 42. The articles which accumulate in the receptacle 47 can be subjected to a test in a laboratory or the like in order to ascertain whether or not they actually exhibit defects of the type which must be ascertained by the testing device 37. If the results are satisfactory, the operation of the testing device 37 is satisfactory and the operator can switch back to segregation of articles which have been found to be defective at the station for the testing device 37 via valve 42 rather than into the recaptacle 47. The same holds true for one or more additional testing devices, i.e., the operator can use the removing device 46 to separate articles 43 which have been found to be defective by any one of the testing devices 38, 39 and 41.

Figure 2:
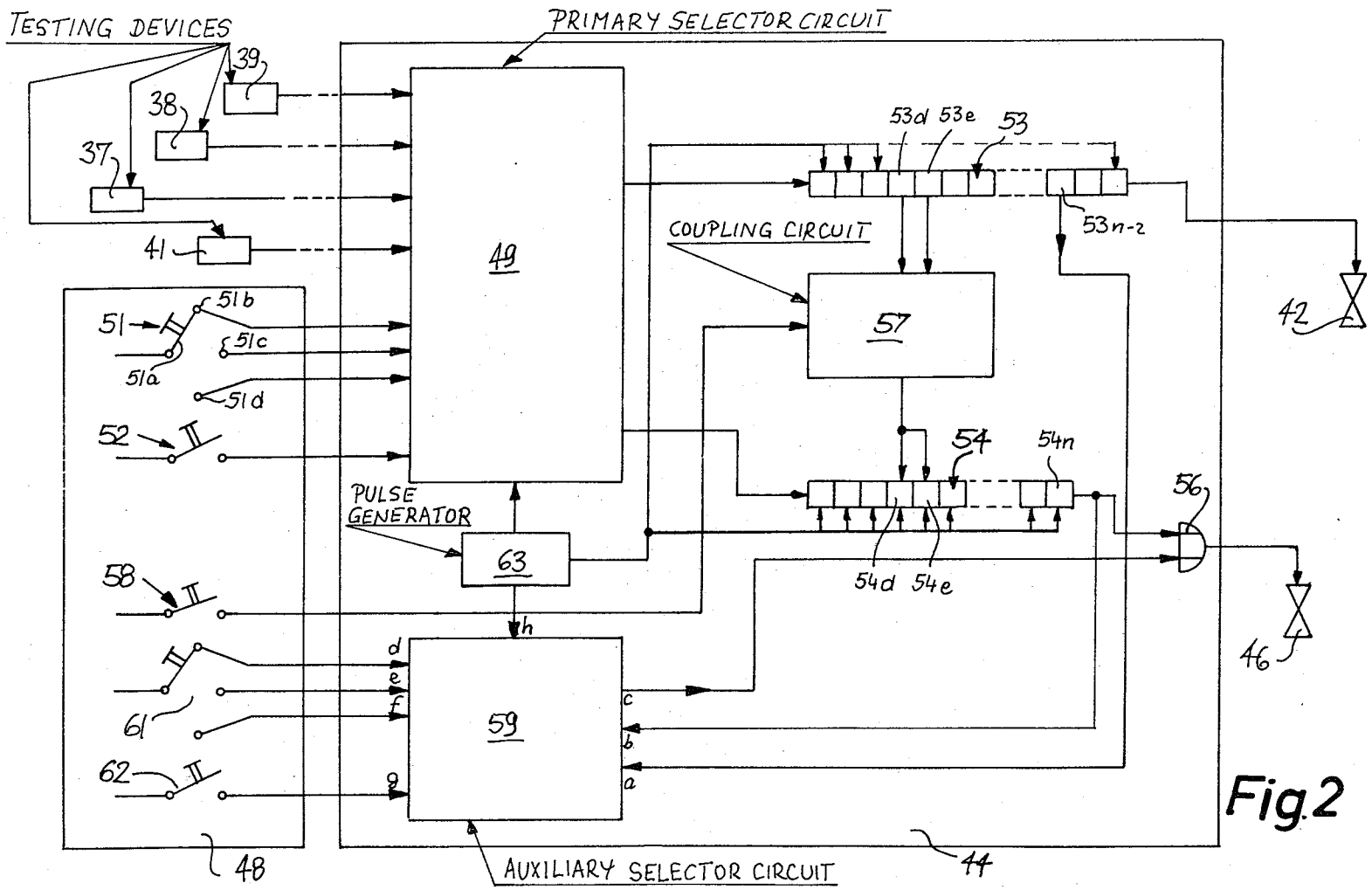
FIG. 2 is a schematic block diagram of the evaluating circuit in the apparatus of FIG. 1.

The construction of the evaluating circuit 44 and of the associated control unit 48 is shown in FIG. 2. The main component or module of the evaluating circuit 44 is a primary selector circuit 49 having two outputs connected with time-delay devices including the parts 53 and 54. The selector circuit 49 has several inputs one of which is connected with and receives signals from the output of the testing device 37, another of which receives signals from the testing device 38, a third of which receives signals from the testing device 39, and a fourth of which receives signals from the testing device 41. Four additional inputs of the primary selector circuit 49 are connected with the corresponding outputs of the control unit 48. The latter comprises a choosing switch 51 which serves to transmit signals denoting the selected testing device (namely, that testing device which is to be monitored as to the quality of its testing operation). The switch 51 has a movable contact **51*a* engageable with a selected one of three stationary contacts 51*b*, 51*c*, 51*d* each of which is connected to a different input of the selector circuit 49, i.e., the evaluating circuit 44 of FIG. 2 is designed to monitor the operation of three out of four testing devices, namely, the testing devices 37, 38 and 39. The reasons for not monitoring the condition or functioning of the testing device 41** will be explained hereinbelow.

The control unit 48 further comprises a starter switch 52 which is normally open and is closed by an operator when the operator desires to gather successive defective or presumably defective articles 43 in the receptacle 47, i.e., when the removal of articles 43 from their path is to take place at the station for the removing device 46 rather than at the station for the segregating valve 42.

The part 53 of the first time-delay device is a shift register 53 the first stage of which is connected with one output of the primary selector circuit 49. The part 54 of the second time-delay device is also a shift register whose first or foremost stage is connected with a discrete second output of the primary selector circuit 49. The last stage of the shift register 53 is connected with the valve 42 which may constitute a solenoid-operated valve whose solenoid receives a signal directly from the last stage of the shift register 53 or by way of a suitable amplifier system whenever the shift register 53 completes the transport of a defect signal in synchronism with conveying of the respective article 43 (which has initiated the generation of such defect signal) to the segregating station accommodating the valve 42 or the nozzle which receives, at times, pressurized fluid from the valve 42. The last stage of the shift register 54 is connected with the article removing device 46 by way of a logic circuit in the form of an OR gate 56. The output of the OR gate 56 can be connected with a solenoid which opens the valve of the removing device 46 in response to reception of a signal so that the valve of the removing device 46 or a nozzle which is associated with such valve effects the expulsion of selected articles 43 into the receptacle 47 (namely, the expulsion of those articles which have been found to be defective by a selected one of the three testing devices 37, 38 and 39).

The evaluating circuit 44 further comprises a coupling circuit 57 having two inputs connected with a pair of neighboring stages **53*d*, 53*e* in the shift register 53 and an output connected with two neighboring stages 54*d*, 54*e* of the shift register 54. A third input of the coupling circuit 57 is connected with a normally closed starter switch 58 of the control unit 48**.

Still further, the evaluating circuit 44 comprises a second or auxiliary selector circuit 59 having inputs a and b which are respectively connected with selected stages of the shift registers 53 and 54, namely, with those stages which effect identical delays of signals simultaneously transmitted to the first stages of the shift registers 53 and 54. Otherwise stated, if a given signal is transmitted to the first stage of the shift register 53 simultaneously with transmission of a predetermined signal to the first stage of the shift register 54, the given signal reaches the stage 53*n*-2 of the shift register 53 simultaneously with advancement of the predetermined signal into the last stage 54*n* of the shift register 54. The output c of the auxiliary selector circuit 59 is connected with one input of the aforementioned OR gate 56.

The auxiliary selector circuit 59 renders it possible to select the number of articles 43 which are to be gathered in the receptacle 47 in response to activation of the removing device 46. To this end, the inputs d, e and f of the circuit 59 are connected with discrete fixed contacts of a three-position choosing or selecting switch 61 in the control unit 48. An input g of the auxiliary selector circuit 59 is connected with a starter switch 62 which can be closed by an attendant in order to activate the auxiliary selector circuit 59.

The stages of the shift registers 53, 54, an input of the primary selector circuit 49, an input (j) of the auxiliary selector circuit 59 and an input of the coupling circuit 57 are connected with the corresponding outputs of a pulse generator 63 which transmits pulses at a frequency which is a function of operating speed of the filter tipping machine, i.e., in synchronism with the speed of transport of articles 43 past and beyond the testing devices 37, 38, 39 and 41.

Figure 3:
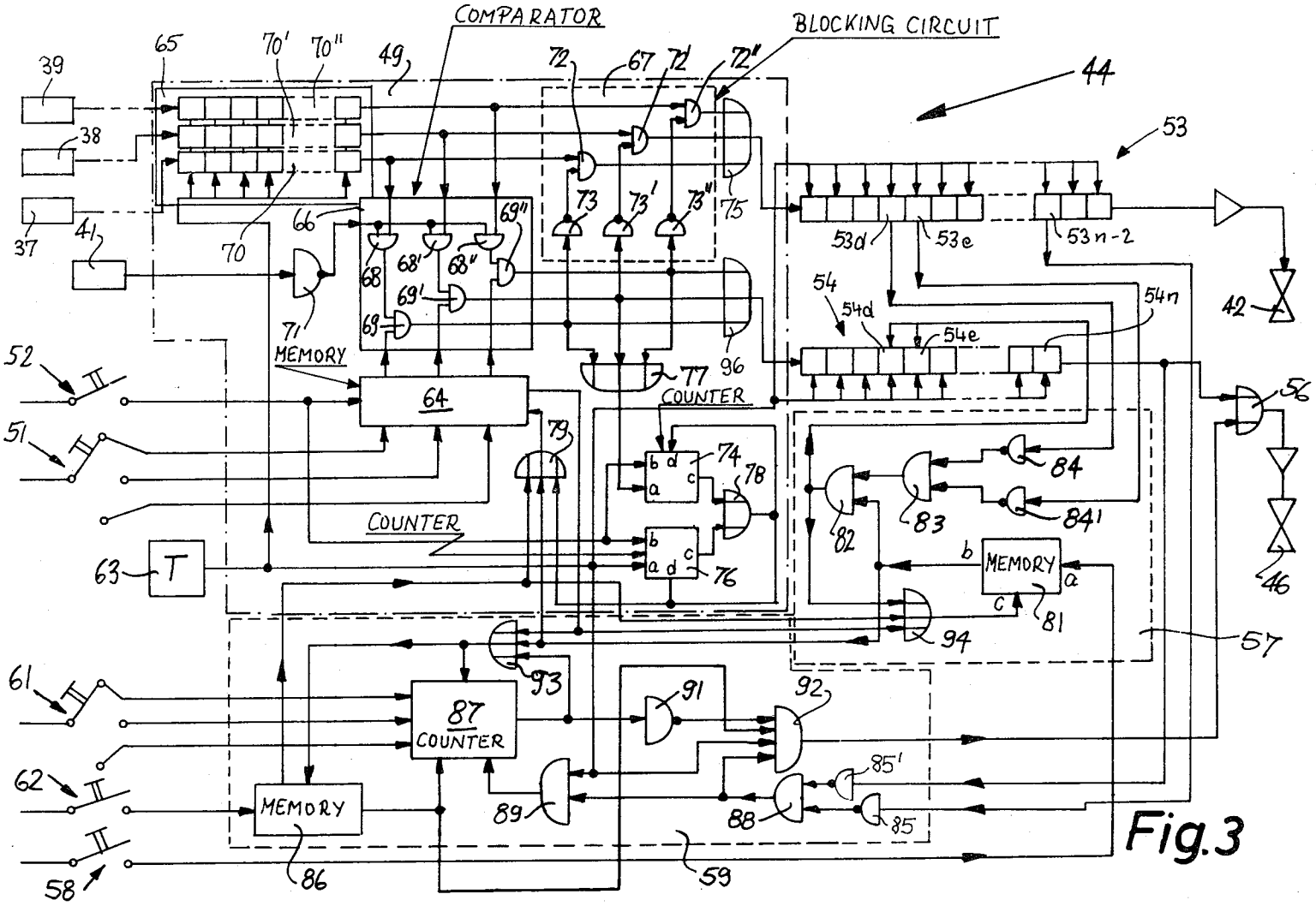
FIG. 3 illustrates various details of the evaluating circuit which is shown in FIG. 2.

The constituents of the evaluating circuit 44 are illustrated in greater detail in FIG. 3.

The primary selector circuit 49 comprises the following components: A memory 64, a delay unit 65, a comparator circuit 66, and a blocking circuit 67. The delay unit 65 is common to the two time-delay devices including the shift registers 53, 54 and comprises three delaying portions 70, 70' and 70'' each of which is a shift register. The inputs of the first or foremost stages of the shift registers 70, 70' and 70'' are respectively connected with the outputs of the testing devices 37, 38 and 39. The arrangement is such that each of the shift registers 70, 70' and 70'' delays the defect signal from the associated testing device 37, 38 or 39 for a certain interval of time, namely, until the cigarette 43 which has caused the testing device 37, 38 or 39 to generate a defect signal has advanced into the path section 43*a* adjacent to the fourth testing device 41 (this device ascertains the presence or absence of all rod-shaped portions or components in an article 43, normally the presence or absence of filter plugs). Such delaying of signals by the shift registers 70 to 70'' allows for simultaneous processing or evaluation of signals from all four testing devices.

The comparator circuit 66 of the primary selector circuit 49 comprises a first group or set of logic circuits in the form of AND gates 68, 68', 68'' and a second set or group of AND gates 69, 69', 69''. The output of the last stage of the shift register 70 is connected with one input of the AND gate 68, the output of the last stage of the shift register 70' is connected with one input of the AND gate 68', and the output of the last stage of the shift register 70'' is connected with one input of the AND gate 68''. Each of the AND gates 68 to 68'' has a second input, and such second inputs are connected with the output of the fourth testing device 41 by way of an inverter circuit 71. The outputs of the AND gates 68 to 68'' are respectively connected with the corresponding (first) inputs of the associated AND gates 69, 69' and 69''. The second inputs of the AND gates 69 to 69'' are connected with the corresponding outputs of the memory 64. Three inputs of the memory 64 are connected with the stationary contacts of the choosing switch 51, and a further setting input of the memory 64 is connected with the starter switch 52. As mentioned above, the operator will actuate the switch 51 to pick one of the testing devices 37, 38, 39 for evaluation or monitoring of its operation, and the starter switch 52 is closed when the operator desires the apparatus to start with removal of articles 43 (which have been found to be defective by the testing device 37, 38 or 39) at the locus of the removing device 46.

The outputs of the AND gates 69, 69' and 69'' in the comparator circuit 66 are connected with the first or foremost stage of the shift register 54 by an OR gate 96. It will be noted that signals which are transmitted by the testing devices 37, 38 and 39 are delayed first in the corresponding shift registers 70, 70' and 70'', and thereupon in the shift register 54. The shift registers 70 to 70'' on the one hand and the shift register 54 on the other hand can be said to constitute two units of the second time-delay device for defect signals or second signals which are to be transmitted from the testing devices 37, 38, 39 to the removing device 46.

The outputs of the testing devices 37, 38, 39 and of the corresponding shift registers 70, 70', 70'' are further connected with the corresponding (first) inputs of AND gates 72, 72', 72'' forming part of the blocking circuit 67. The second inputs of the AND gates 72, 72', 72'' are respectively connected with the outputs of associated inverters 73, 73', 73'' also forming part of the blocking circuit 67. The inputs of the inverters 73, 73', 73'' are respectively connected with the outputs of the aforementioned AND gates 69, 69', 69'' which form part of the comparator circuit 66. The outputs of the AND gates 72, 72', 72'' in the blocking circuit 67 are connected with the corresponding inputs of a common OR gate 75 whose output is connected with the first stage of the shift register 53. The shift register 53 can be said to constitute the second unit of the first time delay device whose first unit is the unit 65, i.e., the unit 65 including the shift registers 70, 70' and 70''.

The blocking circuit 67 invariably ensures that defect signals which are transmitted to the shift register 54 cannot be transmitted to the shift register 53, i.e., that any defect signals which are generated by the testing device selected by the switch 51 will not reach the valve 42 of the segregating means. This is especially important if the valve 42 is installed upstream of the removing device 46.

The primary selector circuit 49 further comprises two counters 74 and 76 the first of which determines the number of articles 43 to be gathered in the receptacle 47 and the second of which determines the length of the interval of removal of articles 43 at the station accommodating the removing device 46. The counter 74 has a counting input a which is connected with the outputs of the comparator circuit 66 by way of an OR gate 77. The counting input a of the second counter 76 is connected with the pulse generator 63. The setting inputs b of the counters 74 and 76 are connected with the starter switch 52 of the control unit 48, the outputs c of the counters 74, 76 are connected with the corresponding inputs of an OR gate 78, and the resetting inputs d of the two counters are connected with the output of the OR gate 78. The output of the OR gate 78 is further connected with the erasing input of the memory 64 by way of an OR gate 79.

The coupling circuit 57 comprises a memory 81 having an input a which is connected with the starter switch 58 of the control unit 48 and an output b connected with one input of an AND gate 82. The other input of the AND gate 82 is connected with the output of an AND gate 83 having first and second inputs respectively connected with inverters 84 and 84'. The inputs of the inverters 84 and 84' are connected with the two neighboring stages 53*d*, 53*e* of the shift register 53. The output of the AND gate 82 is connected with the two neighboring stages 54*d*, 54*e* of the shift register 54. The resetting input c of the memory 81 in the coupling circuit 57 is connected with the output of an OR gate 94.

The second or auxiliary selector circuit 59 comprises a memory 86 having an input which is connected with the starter switch 62 of the control unit 48. One output of the memory 86 is connected with one input of a preselect counter 87 which has three additional inputs connected with the choosing switch 61 of the control unit 48. The counting input of the counter 87 is connected with inverters 85, 85' (and hence with two predetermined stages of the shift registers 53, 54) by way of an AND gate 88 and a further AND gate 89. The inverter 85 is connected with the stage 53*n*.2 of the shift register 53, and the inverter 85' is connected with the last stage 54*n* of the shift register 54. The output of the preselect counter 87 is connected with the article removing device 46 by way of an inverter 91, an AND gate 92 and the aforementioned OR gate 56. One input of the AND gate 89 is connected with the output of the AND gate 88, and the other input of the AND gate 89 is connected with the output of the pulse generator 63.

The output of the inverter 91 is connected with one input of the AND gate 92 which has another input connected with the output of the pulse generator 63 and a third input connected with the output of the AND gate 88. A fourth input of the AND gate 92 is connected with the output of the memory 86.

The resetting input of the preselect counter 87 and the erasing input of the memory 86 in the auxiliary selector circuit 59 are connected with the output of the preselect counter 87 by way of an OR gate 93, with the output c of the memory 81 in the coupling circuit 57 and with an output of the memory 64 in the primary selector circuit 49. The erasing or resetting input c of the memory 81 in the coupling circuit 57 is connected (by way of the OR gate 94) with the output of the AND gate 82. Furthermore, the erasing input of the memory 81 is connected with an output of the memory 64 in the primary selector circuit 49 and with the memory 86 of the second or auxiliary selector circuit 59. The inputs of the OR gate 79 are connected with the outputs of the counters 74, 76, with the outputs of the memory 81 in the coupling circuit 57, and with the output of the memory 86 in the auxiliary selector circuit 59.

The just discussed connections between the memories 64, 81 and 86 ensure that the removing means 46 invariably expels only such articles which are pinpointed by setting of the choosing switch 51 or 62 or by closing of the starter switch 58. This is accomplished by the simple expedient of ensuring that the activated memory transmits signals to the erasing or deactivating inputs of the other two memories.

The delay unit 65 and the shift register 53 can be said to constitute a first signal transporting means which serves to transport defect signals from the testing devices 37, 38, 39 to the segregating device including the valve 42 in synchronism with the conveying to the respective defective or presumably defective articles 43 from the testing devices 37, 38, 39 to the segregating means. The delay unit 65 and the shift register 54 can be said to constitute a second signal transporting means which transports defect signals or second signals from a selected testing device 37, 38 or 39 to the removing device 46 in synchronism with the conveying of corresponding articles 43 from the selected testing device to the removing device 46. The switch 52 can be said to constitute a means for activating the second signals transporting means including the unit 65 and shift register 54.

The operation of the apparatus is as follows:

Rod shaped articles 43 (filter cigarettes of unit length) which are produced in the filter tipping machine of FIG. 1 advance seriatim beyond the turn-around device 29 and are tested by the devices 37, 38 during travel along the periphery of the rotary drum-shaped conveyor 31 prior to being tested by the devices 39, 41 during travel along the periphery of the rotary drum-shaped conveyor 32. As explained hereinbefore, each of the four testing devices monitors a different parameter or characteristic of the article 43 which is within its range, and such testing devices ascertain whether or not the monitored parameters are acceptable, i.e., whether or not the tested articles exhibit certain defects including the presence of open seams, holes or frayed ends (testing device 37), acceptable or unsatisfactory permeability of selected portions of the wrappers (testing device 38), unsatisfactory or acceptable density of the so-called heads of articles 43 (testing device 39) and/or the presence or absence of all constituents of the articles 43 (each such article comprises at least two rod-shaped constituents but it may comprise more than two constituents if the testing takes place prior to subdivision of filter cigarettes of double unit length into articles 43 of unit length and/or if the filter plugs of articles 43 are composite plugs consisting of two or more coaxial rod-shaped portions, i.e., if the filter plugs are so-called multiplex filter plugs).

If an article 43 is classified as defective by one or more testing devices, the respective testing device or devices generate first or defect signals which can be said to "accompany" the defective articles or are associated with such articles so that they reach or influence the valve 42 of the segregating device at the time when the articles which have caused the generation of defect signals are in optimum positions for segregation from the path along which the acceptable articles advance toward the upper reach of the belt conveyor 36. The evaluating circuit 44 effects delayed transmission of defect signals to the valve 42 in such a way that this valve opens whenever a defective article 43 is within its range or within the range of the nozzle that receives gaseous fluid on opening of the valve 42.

As mentioned above, the path along which the articles 43 advance past the testing devices 37, 38, 39 and 41 as well as toward and past the valves 42, 46 consists of several sections 43*a* of identical length. In the illustrated embodiment wherein the conveyors 31 and 32 are fluted drums, the length of each of the sections 43*a* matches the distance between the centers of two neighboring flutes 31*a* on the conveyor 31 or between two neighboring flutes 32*a* on the conveyor 32. By resorting to such sections 43*a*, one can define a so-called clock time or increment of time which elapses while an article 43 advances along a section 43*a*, i.e., along an arc corresponding to that between the centers of two neighboring flutes 31*a* or 32*a*. Otherwise stated, each such increment of time equals the interval which elapses during movement of an article 43 from its momentary position to the position occupied, at the same time, by the immediately preceding article 43. If such increment of time is called or designated a cycle time, the delay which is needed to transport a defect signal from the respective testing device 37, 38, 39 or 41 (i.e., from one of the four predetermined first path sections 43*a*) to the valve 42 (i.e., to the predetermined second path section 43*a*) is a function of the number of sections 43*a* between the corresponding testing device 37, 38, 39 or 41 and the predetermined second path section. Since the testing devices 37, 38, 39 and 41 are not adjacent to one and the same path section 43*a* (i.e., they are located one behind the other, as considered in the direction of conveying of articles 43 from the turn-around device 29 to the belt conveyor 36), it is necessary to delay a defect signal from the testing device 37 for a period of time which is longer than the period of delay of a defect signal from the testing device 38, 39 or 41; to delay a defect signal from the testing device 38 for a period of time which is longer than that required for delaying a defect signal from the testing device 39 or 41; and to delay a defect signal from the testing device 39 for an interval of time which is longer than the period of delay of a defect signal from the testing device 41. The duration of delays depends on the number of path sections 43*a* between the valve 42 and the respective testing devices (i.e., those testing devices which happened to generate defect signals during travel of articles 43 therealong).

The just described mode of transporting defect signals in imitation of transport of articles 43 from the corresponding testing stations to the valve 42 is similar to that described in the German Offenlegungsschrift No. 21 13 841. This ensures that the valve 42 can effect segregation of any and all defective articles 43 irrespective of whether the defect signals were generated by the testing device 37, 38, 39 and/or 41. The valve 42 effects segregation of all defective articles 43 into a common collecting receptacle or countainer which can be connected with a device for recovery of tobacco from defective or presumably defective articles. A suitable device which can be utilized to recover tobacco shreds from defective cigarettes is disclosed, for example, in commonly owned U.S. Pat. No. 3,255,762 granted June 14, 1966 to Anton Baier.

Since all defective or presumably defective articles 43 enter a common receptacle which receives such articles from the (second predetermined) path section 43*a* that is in the range of the segregating means including the valve 42, it is not possible to classify the thus ejected articles according to defects or presumed defects which were detected by the testing device 37, 38, 39 or 41. In other words, a person inspecting the articles which were segregated by the valve 42 is not in a position to ascertain, by examining a certain article 43, whether or not the testing device 37, 38, 39 and/or 41 operates properly because of the inability of such person to ascertain whether a given article was segregated in response to a defect signal from the testing device 37, 38, 39 and/or 41. However, it is most likely that the person inspecting the gathering bin for defective or presumably defective articles will be able to ascertain the accuracy or lack of accuracy of functioning of the testing device 41 by assuming that all articles 43 without filter plugs or without plain cigarettes were segregated in response to signals from the testing device 41.

The evaluating circuit 44, in combination with the control unit 48, enables an attendant to rapidly accumulate (in the receptacle 47) a requisite number of articles 43 which were removed by the device 46 in response to signals from a selected one of the testing devices 37, 38, 39. Consequently, the articles 43 which accumulate in the receptacle 47 can be readily withdrawn and transferred or transported to a laboratory for careful examination of the respective parameter or parameters and for attendant determination whether or not the selected testing device 37, 38 or 39 operates properly. All the operator in charge has to do is to select one of the testing devices 37, 38, 39 by appropriate setting of movable contact 51*a* of the choosing switch 51 in the control unit 48 and to thereupon close the starter switch 52. As a result of such adjustment of the contact 51*a* and of closing of the starter switch 52, articles 43 which have caused the selected testing device 37, 38 or 39 to generate defect signals are not permitted to advance all the way to the (predetermined second) segment 43*a* which is associated with the valve 42 but rather only to the (predetermined third) segment 43*a* from which the device 46 removes such articles 43 and causes them to descend into the receptacle 47.

It is now assumed that the operator in charge wishes to ascertain the condition of the testing device 37 by way of an inspection of articles 43 which are removed in response to defect signals from the testing device 37. The evaluating circuit 44 is then adjusted in such a way that it prevents articles 43 which have caused the testing device 37 to generate defect signals (signals of the first type) from advancing all the way to the predetermined second path section 43*a* (valve 42); instead, the presumably defective articles 43 (which are assumed to have open seams, frayed ends, relatively large holes or similar defects in their wrappers) are to advance only to the predetermined third path section 43*a*, i.e., into the range of the removing device 46.

In a first step, the attendant moves the movable contact 51*a* of the choosing switch 51 to the appropriate one of the three different positions, for example, to the position which is shown in FIG. 3. In the next step, the attendant in charge closes the starter switch 52 so as to activate the memory 64 in the primary selector circuit 49. This means that one of the three outputs of the memory 64 transmits a signal, namely, a signal to the corresponding input of the AND gate 69. If the other input of the AND gate 69 then receives a defect signal from the output of the testing device 37 via shift register 70 and AND gate 68, the output of the AND gate 69 transmits a signal to the first stage of the shift register 54 via OR gate 96. The just mentioned defect signal can denote that the wrapper of the article 43 in question exhibits a pronounced leak such as evidently warrants segregation of the respective article 43, i.e., the article should not reach the belt conveyor 36 and thence a packing machine wherein it could be packed with satisfactory articles 43. The purpose of the shift register 70 is to delay the transfer of defect signal from the output of the testing device 37 to the first stage of the shift register 54, i.e., in synchronism with advancement of the tested (defective or presumably defective) article 43 from the station accommodating the testing device 37 toward the station for the removing device 46. The rate at which the defect signal is advanced by the shift register 70 depends on the frequency of pulses which are generated by the pulse generator 63, i.e., on the speed at which the articles 43 are advanced through the filter tipping machine. In the illustrated embodiment, the shift register 70 contains twelve stages because the distance between the first or foremost testing device 37 and the station for the last testing device 41 equals twelve sections 43*a*. When the filter cigarette 43 which has caused the testing device 37 to generate a defect signal reaches the station of the testing device 41, the corresponding defect signal has reached the output of the shift register 70. The testing device 41 monitors the condition of the article 43 at the station which is separated by twelve sections 43*a* from the station for the foremost testing device 37 and, if such article contains all of its essential constituents or components (in the illustrated embodiment, the device 41 monitors successive articles 43 for the presence or absence of filter plugs), the testing device 41 does not generate a defect signal so that the input of the inverter 71 does not receive a defect signal but the output of the inverter 71 transmits a signal to the left-hand input of the AND-gate 68, as viewed in FIG. 3. Since the right-hand input of the AND gate 69 receives a signal from the output of the shift register 70, the output of the AND gate 68 transmits a signal to the corresponding input of the AND gate 69 whose other input receives a signal from the corresponding output of the activated memory 64. Therefore, the output of the AND gate 69 transmits a signal to the first stage of the shift register 54 via OR gate 96. The signal at the input of the inverter 71 can be called a signal of the second type (i.e., it is not indicative of an article that is defective insofar as the testing device 41 is concerned). The signal at the output of the inverter 71 can be called a HIGH signal, namely, a signal which suffices to enable the AND gate 68 to transmit a signal if such gate simultaneously receives a defect (HIGH) signal from the shift register 70. The number of stages in the shift register 54 corresponds to the number of path sections 43*a* between the testing device 41 and the third predetermined section 43*a*, i.e., between the testing device 41 and the section from which the removing means 46 can expel articles 43 into the receptacle 47. The shift register 54 transports the defect signal from the OR gate 96 to the removing means 46 via OR gate 56 so that the removing means 46 effects expulsion of the respective article 43 into the receptacle 47.

The blocking circuit 67 serves to prevent the transmission of signals which effect activation of removing means 46 to the output of the shift register 53, i.e., such signals must be prevented from effecting opening of the valve 42 at the time a defective or presumably defective article 43 is on its way toward and into the receptacle 47. Thus, when the output of the AND gate 69 (i.e., the corresponding output of the comparator circuit 66) transmits a HIGH signal, the inverter 73 of the blocking circuit 67 converts such signal into a LOW signal so that the AND gate 72 prevents a defect signal at the output of the shift register 70 from reaching the first stage of the shift register 53 via OR gate 75.

Since the outputs of the AND gates 69' and 69'' transmit LOW signals (due to the fact that no signals are transmitted by the associated outputs of the memory 64), the inverters 73' and 73'' transmit HIGH signals to the respective inputs of the AND gates 72' and 72'' so that these gates are ready to transmit defect signals from the testing devices 38 and 39 (via shift registers 70' and 70'') to the input of the shift register 53. In other words, the articles 43 which are tested by the devices 38 and 39 and are found to be defective because of unsatisfactory permeability of selected portions of their wrappers and/or unsatisfactory density of their heads are segregated by the valve 42 in the customary way as soon as they reach the respective second predetermined section 43*a*, i.e., as soon as a defect signal reaches the output of the shift register 53. As mentioned above, the shift register 53 constitutes the second unit of a composite first time-delay means which further includes the delay unit 65 of the primary selector circuit 49. The connection between these two units of the composite first time-delay means includes the AND gates 72, 72', 72'' and the OR gate 75. The number of stages in the shift register 53 corresponds to the number of sections 43*a* between the last testing device 41 and the valve 42. Thus, a defect signal which is generated by the testing device 38 or 39, while the defect signals from the testing device 37 are fed to the input of the shift register 54, can effect segregation of the corresponding articles 43 at the station for the valve 42 in the same way as if the starter switch 52 of the control unit 48 were open.

Closing of the starter switch 52 in order to activate the memory 64 of the primary selector circuit 49 further results in transmission of signals to the inputs b of the counters 74 and 76. As mentioned above, the counter 74 limits the number of articles 43 which are delivered to the receptacle 47, and the counter 76 limits the period of time during which the shift register 54 can deliver signals to the removing means 46 for expulsion of articles 43 from the path on the conveyor 32 into the receptacle 47. Each of these counters is preferably adjustable so as to allow for selection of a given number of defective or presumably defective articles 43 which are to enter the receptacle 47 and/or to vary the interval of time during which the shift register 54 can transmit defect signals to the removing device 46.

The input a of the counter 74 receives HIGH signals from the output of the AND gate 69 (it being assumed that the receptacle 47 receives articles 43 in response to defect signals from the testing device 37) via OR gate 77 whereby the counter 74 counts the number of defect signals which are transmitted by the testing device 37 subsequent to closing of the starter switch 52. When the number of HIGH signals which were transmitted to the input a of the counter 74 matches the predetermined or preselected maximum permissible number of such signals, the output c of the counter 74 transmits a signal to the erasing input d (via OR gate 78) as well as to the erasing input of the memory 64 via OR gate 79. This terminates the delivery of defective or presumably defective articles 43 into the receptacle 47 in response to defect signals from the testing device 37.

The counter 76 counts successive articles 43 irrespective of their condition. This is due to the fact that it receives pulses from the pulse generator 63 which is assumed to generate pulses in response to transport of successive articles 43 by increments corresponding to the length of a path section 43*a*. When the total number of pulses transmitted to the input a of the counter 76 matches a preselected number (e.g., 30,000 articles), the output c of the counter 76 transmits a signal (via OR gate 78) to its erasing input d as well as to the corresponding input of the memory 64 by way of the OR gate 79. This deactivates the memory 64 so that the latter ceases to transmit a signal to the corresponding input of the AND gate 69 with the result that the shift register 54 is incapable of transmitting defect signals to the removing means 46. The signal which then appears at the output c of the counter 76 is also transmitted to the resetting input d of the counter 74 so that the counter 74 is reset to zero simultaneously with the counter 76. The same holds true in reverse, i.e., when the output c of the counter 74 transmits a signal to the resetting input d of this same counter, such signal is also transmitted to the resetting input d of the counter 76. In other words, the counters 74 and 76 are reset to zero simultaneously and effect a deactivation of the memory 64 irrespective of whether the counter 74 detects a given number of defective articles 43 which are already located in or are about to enter the receptacle 47, or the counter 76 detects a given total number of defective and satisfactory articles during a selected interval of time which begins with closing of the starter switch 52.

By actuating the switch 51, the operator in charge can select any one of the testing devices 37, 38 and 39 for indirect inspection of its functioning, i.e., by causing the articles 43 which have been found to be defective by the selected testing device to accumulate in the receptacle 47. As mentioned above, the number of testing devices which can be selected by the switch 51 is three, namely, the switch 51 can be set to allow for removal (at 46) of defective or presumably defective articles in response to signals from the testing device 37, 38 or 39. One of the reasons is that the inclusion of the fourth testing device 41 would merely entail the addition of several further components in the circuits which are shown in FIGS. 2 and 3 without contributing to better understanding of the invention. Furthermore, the testing device 41 is or can be considered optional because the absence of filter plugs can be ascertained in a number of other ways, for example, by monitoring the staggering conveyor 8, the shuffling conveyor 9 or the inserting conveyor 11 in the filter tipping machine of FIG. 1. It will be readily appreciated that the number of testing devices which can be selected by the switch 51 can be reduced to two or increased to four or more, depending on the nature of such testing devices and/or on their overall number. Moreover, all of the testing devices need not be grouped as closely as shown in FIG. 1. For example, one or more testing devices can be installed in the cigarette making machine which supplies plain cigarettes to the conveyor 1 of FIG. 1 and/or in the filter rod making machine which supplies filter rod sections to the magazine 4.

If the operator decides to select the testing machine 38 or 39, the choosing switch 51 is adjusted accordingly and the starter switch 52 is closed to enable the memory 64 to transmit a signal to the corresponding input of the AND gate 69' or 69''. The mode of operation is the same as before except that the shift register 54 transmits defect signals from the testing device 38 or 39 while the defect signals from the other two testing devices continue to effect segregation of corresponding articles 43 by way of the valve 42.

The apparatus of the present invention can be used with equal advantage for removal of satisfactory or acceptable articles 43, i.e., of articles which do not cause the testing device 37, 38, 39 and/or 41 to generate defect signals (signals of the first type). To this end, the switch 61 of the control unit 48 is adjusted to select a given number of articles 43 which entails an appropriate adjustment of the preselect counter 87. In the next step, the operator in charge closes the starter switch 62 to activate the memory 86 which transmits a signal to and sets the counter 87. In order to ensure that the apparatus will effect removal of satisfactory articles 43 only, i.e., that the articles which are about to be removed did not cause the generation of defect signals during travel past the testing device 37, 38, 39 and/or 41, it is necessary to scan the output of the shift register 54 and the corresponding stage of the shift register 53 (i.e., the last stage 54*n* of the shift register 54 and the stage 53*n*-2 of the shift register 53). If the output of the shift register 54 as well as the stage 53*n*-2 of the shift register 53 transmit LOW signals, i.e., if such stages fail to transmit defect or HIGH signals, the inverters 85 and 85' of the second or auxiliary selector circuit 59 transmit HIGH signals to the corresponding inputs of the AND gate 88 whose output transmits a HIGH signal to the corresponding inputs of the AND gates 89 and 92. The other input of the AND gate 89 receives pulses (HIGH signals) from the pulse generator 63 so that its output transmits HIGH signals to the counting input of the counter 87 at a frequency which is determined by the pulse generator 63. Before the number of signals transmitted by the output of the AND gate 89 matches the preselected number of signals (depending on the setting of the switch 61), the output of the counter 87 transmits a LOW signal which is inverted by the inverter 91 and is applied, as a HIGH signal, to the corresponding input of the AND gate 92. As mentioned above, another input of the AND gate 92 receives a HIGH signal from the output of the AND gate 88. A further input of the AND gate 92 receives a HIGH signal from the output of the memory 86 because the switch 62 is closed. The remaining input of the AND gate 92 receives pulses (HIGH signals) from the pulse generator 63 so that the output of the gate 92 transmits HIGH signals at the frequency which is determined by the pulse generator 63, and such HIGH signals are applied to the removing device 46 by way of the OR gate 56. Thus, all articles 43 which are conveyed into the range of the device 46 while the switch 62 is closed are admitted into the receptacle 47. The articles 43 which reach the path section 43*a* for the removing device 46 are those which did not cause the generation of defect signals during travel past the testing device 37, 38, 39 and/or 41.

When the number of articles 43 which accumulate in the receptacle 47 in response to closing of the starter switch 62 reaches the number which has been selected by the switch 61, the output of the preselect counter 87 transmits a HIGH signal to the inverter 91 which transmit a LOW signal to the corresponding input of the AND gate 92 with the result that the latter ceases to transmit a HIGH signal to the OR gate 56 and removing device 46. At the same time, the output of the counter 87 transmits a signal to the OR gate 93 which transmits signals to the resetting input of the counter 87 as well as to the erasing input of the memory 86. The admission of articles 43 into the receptacle 47 is terminated as soon as the AND gate 92 ceases to transmit HIGH signals.

Still further, the apparatus of the present invention renders it possible to withdraw pairs of successive articles 43 from the path including the sections 43*a*. This is achieved by the provision of the coupling circuit 57. In the first step, the operator in charge closes the starter switch 58 of the control unit 58 to transmit a signal to the input a of the memory 81 in the coupling circuit 57. The output b of the memory 81 transmits a HIGH signal to the corresponding input of the AND gate 82. The stages 53*d* and 53*e* transmit LOW signals to the inputs of the inverters 84 and 84' whose outputs transmit HIGH signals to the corresponding inputs of the AND gate 83. The output of the AND gate 83 transmits a HIGH signal to the second input of the AND gate 82. Such situation develops when the stages 53*d* and 53*e* transmit LOW signals, i.e., when the articles 43 that are "associated" with such LOW signals are not defective. The output of the AND gate 82 is the output of the coupling circuit 57. If this output transmits a HIGH signal, such HIGH signal is applied to the stage 54*d* and 54*e* of the shift register 54, i.e., to the stages which respectively correspond to the stages 53*d* and 53*e*. Since the articles 43 which have caused the generation of LOW signals are satisfactory articles, they could advance past and beyond the valve 42 but are ejected into the receptacle 47 during travel past the removing means 46. Removal of pairs of successive articles 43 renders it possible to monitor the quality of imprints on the wrappers of articles 43. The imprints can be made by a suitable imprinting mechanism in the machine which supplies plain cigarettes to the conveyor 1 of FIG. 1. Reference may be had to commonly owned U.S. Pat. No. 4,236,534 granted Dec. 2, 1980 to Uwe Heitmann et al. wherein FIG. 1 shows an imprinting device 14.

When the attendant in charge has closed the starter switch 52, i.e., when the memory 64 is caused to transmit a signal to the corresponding input of the AND gate 69, 69' or 69'', the right-hand output of the memory 64 (as viewed in FIG. 3) transmits blocking signals to the input C of memory 81 (via OR gate 94) and to the resetting input of the memory 86 via OR gate 93. When the attendant in charge closes the starter switch 62, an output of the memory 86 transmits blocking signals to the corresponding input of the memory 64 via OR gate 79 and to the input c of the memory 81 via OR gate 94. When the starter switch 58 is closed, the output b of the memory 81 transmits blocking signals to the memory 64 via OR gate 79 and to the memory 86 via OR gate 93. This ensures that only one of several possible articles withdrawing or ejecting operations can take place at any time, i.e., that the receptacle 47 can receive articles 43 which have been identified as defective by the testing device 37, 38 or 39 (depending on the setting of the switch 51), that the receptacle 47 can receive pairs of articles in response to closing of the starter switch 58, or that the receptacle 47 can receive satisfactory articles 43 in response to closing of the starter switch 62. However, it is not possible to admit into the receptacle 47 satisfactory articles when the switch 52 is closed, to admit into the receptacle 47 defective articles when the switch 58 or 62 is closed, to admit into the receptacle 47 pairs of articles 43 when the switch 62 is closed, or to admit into the receptacle 47 a long succession of satisfactory articles 43 when the switch 58 is closed.

The output of the testing device 41 transmits defect signals when it ascertains the presence of an incomplete article, especially an article without a filter plug. This causes the output of the inverter 71 to transmit a LOW signal so that the transmission of a defect signal from the selected testing device 37, 38 or 39 to the shift register 54 is prevented. As a rule, incomplete articles (e.g., those without filter plugs) invariably lead to the generation of defect signals, often ahead of the testing device 41 or in the absence of such testing device. This will be readily appreciated since, if the foraminous zone of the wrapper surrounds the filter plug of a filter cigarette 43, absence of the filter plug will be detected by the testing device 38 which monitors the permeability of selected portions of wrappers on successive filter cigarettes 43. Nevertheless, it is advisable to connect the output of the testing device 41 with the comparator circuit 66 of the primary selector circuit 49 by way of the inverter 71 or an analogous circuit because an incomplete cigarette is not likely to facilitate a determination whether or not the testing device 37, 38 or 39 operates properly. Whenever the device 41 generates a test signal, the corresponding cigarette is invariably conveyed all the way to the valve 42 and is segregated with other defective cigarettes, even at such times when the starter switch 52 is closed so that defective cigarettes detected by one of the testing devices 37–39 are assumed to be gathered in the receptacle 47 and even if a cigarette which has been found to be defective by the testing device 41 was also found to be defective by the selected testing device 37, 38 or 39.

As mentioned hereinbefore, the improved apparatus is susceptible of many further modifications without departing from the spirit of the invention. For example, the removing device 46 can be installed downstream of the valve 42 (i.e., the third predetermined path section 43*a* can be located downstream of the second predetermined path section 43*a*) so that the number of stages in the shift register 54 then exceeds the number of stages in the shift register 53. Also, the sequence in which the articles 43 are tested for the presence or absence of specific defects can be changed; for example, the head testing device 39 can be installed upstream of the testing devices 37, 38 and 41. The testing device 41 can be placed next to the severing conveyor 26 of FIG. 1, the permeability testing device 38 can be placed adjacent to the path of transport of the web 13, and so forth. All such modifications merely necessitate appropriate (and rather minor) changes of the evaluating circuit 44. In many instances, the modifications (such as placing of the removing device 46 downstream of the valve 42) merely necessitate the utilization of different shift registers or analogous time-delay means.

An important advantage of the improved method and apparatus is that there is no need to provide discrete collecting or intercepting receptacles for different types of defective articles, i.e., for articles which are segregated in response to defect signals from the testing device 37, 38, 39 or 41. A single collecting or intercepting receptacle suffices to collect all defective or presumably defective articles which are segregated from the remaining articles during travel past the valve 42. In spite of this, the improved apparatus ensures that one can immediately separate from the remaining defective articles those which have caused the generation of defect signals during travel past a selected testing device. This means that, in spite of resort to only two segregating or removing means (including the valve 42 and device 46), one can gather all defective articles in a common receptacle (which receives such articles from or in response to opening of the valve 42) and one can gather any selected articles (either articles which exhibit a certain defect, articles which are satisfactory or pairs of successive articles) in a second receptacle (47) whenever the operator in charge so desires. This renders it possible to ascertain the quality of the testing operation of any one of the several testing devices by the simple expedient of diverting the articles which have been designated as defective by a particular testing device into the receptacle 47 instead of into the receptacle for the remaining defective or presumably defective articles. The circuitry which constitutes or forms part of the evaluating circuit 44 is relatively simple in spite of the fact that it can be used to effect indirect monitoring of the mode of operation of any one of plural testing devices.

The improved method and apparatus can be utilized with particular advantage in connection with the production of filter cigarettes, i.e., in or in association with a filter tipping machine. As mentioned above, the testing devices which are to be monitored can be installed in the filter tipping machine proper, in the filter cigarette making machine which supplies plain cigarettes to the conveyor 1 of FIG. 1, and/or in the filter rod making machine which supplies filter rod sections to the magazine 4 of FIG. 1. A suitable filter rod making machine is known as "KDF" and is manufactured and sold by the assignee of the present application. Reference may be had to commonly owned U.S. Pat. No. 4,132,189 granted Jan. 2, 1979 to Heinz Greve et al.

By rendering it possible to remove satisfactory articles 43 (in response to closing of the starter switch 62), the apparatus of the present invention can be used for rapid and reliable verification that all articles which are on their way onto the upper reach of the belt conveyor 36 are satisfactory, i.e., that the testing devices which are used in the machine of FIG. 1 and/or in the associated machines detect all such defects which warrant segregation of corresponding articles from the row of satisfactory articles advancing toward the conveyor 36. This is rendered possible by the simple expedient of designing the apparatus for removal of articles 43 which do not cause the testing devices 37, 38, 39, 41 to generate (defect) signals of the first type but rather signals of the second type, namely, signals which are indicative of satisfactory articles. When the signals of the second type control, i.e., when the starter switch 62 is closed, signals of the first type are disregarded insofar as expulsion of articles at the station for the removing device 46 is concerned. The provision of auxiliary selector circuit 59 and switches 61, 62 is especially desirable in view of the high output of a modern filter tipping machine. Thus, it would be quite cumbersome to remove by hand a certain number of satisfactory cigarettes from a filter tipping machine which turns out in excess of 100 filter cigarettes per second.

Still another advantage of the improved method and apparatus is that they render it possible to inspect the imprints on filter cigarettes by the simple expedient of permitting removal of pairs of successive cigarettes 43 in response to closing of the starter switch 58 and attendant energization of the coupling circuit 57.

Further advantages of the improved method and apparatus are their simplicity, the possibility to incorporate the apparatus in existing filter rod making, filter tipping and/or cigarette making machines, complete or nearly complete automation of the operations, pronounced versatility, and the absence of need for permanent attention by one or more operators.

The provision of means for segregating successive satisfactory articles and/or for segregating pairs of successive satisfactory articles is an optional but highly advantageous feature of the improved apparatus. Thus, the apparatus can be simplified by omitting those portions of the evaluating circuit which are activatable in response to closing of the starter switch 58 and/or 62; however, the provision of such circuit portions contributes significantly to versatility of the improved apparatus and to the possibility of even more accurate and reliable determination of the condition of articles which have been segregated as defective as well as of articles which have been found to be satisfactory and are about to advance to the next processing station, such as into a packing machine.

A further important advantage of the improved apparatus is that it comprises the counters 74 and 76. This renders it possible to automatically terminate removal of satisfactory or defective articles 43 at the station for the removing device 46 and requires less attention on the part of attendants. In other words, if an attendant happens to forget to open the switch 52, the counter 74 or 76 will terminate the removal of articles which have been found to be defective by the testing device 37, 38 or 39 after a certain interval of time which can be selected by the operator by adjusting the counter 74 and/or 76, i.e., by selecting the maximum number of articles to be removed or the longest interval of removal of articles by the device 46.

The gates and inverters of the coupling circuit 57 can be said to constitute a signal comparing stage which ensures that activation of the memory 81 guarantees the removal of pairs of articles which did not cause the generation of defect signals during travel past the testing device 37, 38, 39 or 41. However, this is not critical because the quality of imprints on cigarettes can normally be determined even if the cigarettes which are elected for determination of the quality of imprints exhibit certain defects such as soft heads, open seams and/or others. Therefore, the coupling circuit 57 can be simplified by designing it in such a way that it initiates removal of pairs of successive articles 43 irrespective of whether or not one of both removed articles exhibit certain minor or even major defects. As a rule, the imprinting mechanism which is used in a cigarette making machine is designed to apply two symmetrical imprints at a time, namely, an imprint to the cigarette paper wrapper of each of two successive cigarettes. Reference may be had to British Pat. No. 1,281,371. Therefore, it is advisable to remove two successive filter cigarettes if one desires to inspect the condition of both imprint applying sections of the mechanism.

Without further analysis, the foregoing will so fully reveal the gist of the present invention that others can, by applying current knowledge, readily adapt it for various applications without ommitting features that, from the standpoint of prior art, fairly constitute essential characteristics of the generic and specific aspects of our contribution to the art and, therefore, such adaptations should and are intended to be comprehended within the meaning and range of equavalence of the appended claims.

We claim:

1. A method of manipulating rod-shaped articles which constitute or form part of smokers' products, comprising the steps of conveying the articles in a predetermined direction and along a predetermined path having a plurality of first sections as well as a second and a third section both located downstream of said first sections; subjecting successive articles to a test in each of said first sections, including respectively generating at each of said first sections signals of first and second types when the articles being tested are respectively defective and satisfactory; normally transporting signals of said first type from each of said first sections to said second section and utilizing such signals of the first type for segregation of the respective articles from said path at said second section; optionally transporting signals of at least one of said first and second types from a selected first section to said third section; and utilizing signals of said one type for removal of the respective articles from said path at said third section.

2. The method of claim 1, wherein one of said second and third sections is located downstream of the other of said second and third sections, as considered in said direction.

3. The method of claim 1, wherein the signals of said one type are the signals of said first type.

4. The method of claim 1, wherein the signals of said one type are the signals of said second type only.

5. The method of claim 1, further comprising the step of optionally removing pairs of successive articles from said path at said third section.

6. The method of claim 1, further comprising the steps of terminating the removal of articles at said third section after elapse of a predetermined interval of time.

7. The method of claim 1, further comprising the steps of counting the number of articles which are removed at said third section and terminating such removal when the number of removed articles matches a predetermined number.

8. The method of claim 1, wherein each article has at least one tubular wrapper and one of said tests includes monitoring the wrappers of successive articles of the presence or absence of leaks.

9. The method of claim 1, wherein each article has at least one tubular wrapper and at least a portion of the wrapper normally exhibits a predetermined permeability, one of said tests including monitoring the permeability of said portions of wrappers of successive articles.

10. The method of claim 1, wherein each article has a tobacco-containing end portion and one of said tests includes monitoring the density of such end portions of successive articles.

11. The method of claim 1, wherein each article normally consists of at least two components and one of said tests includes monitoring successive articles for the presence or absence of all components.

12. The method of claim 1, wherein the distance between any two of said sections of said path is a whole multiple of a unit distance.

13. The method of claim 1, wherein said conveying step includes moving the articles sideways and further comprising the step of interrupting said step of optionally transporting signals of said one type at the will of the operator.

14. In a machine for the production and/or processing of rod-shaped articles which constitute or form part of smokers' products, means for conveying articles seriatim in a predetermined direction and along a predetermined path having a series of sections; at least two article testing devices adjacent to discrete first sections of said path and arranged to generate signals of first and second types when the articles which are tested thereby are respectively defective and satisfactory; signal responsive means for segregation articles from a second section of said path downstream of said first sections; signal responsive means for removing articles from a third section of said path downstream of said first sections; selector means including first signal transporting means for normally transporting signals of said first type from each of said testing devices to said segregating means in sychronism with conveying of the respective articles to effect segregation of such articles from said path, and second signal transporting means activatable to transport signals of at least one of said first and second types from a selected testing device to said removing means in synchronism with the conveying of the respective articles to effect removal of such articles from said path; and means for activating said second signal transporting means.

15. The structure of claim 14, further comprising means for choosing that testing device from which said second transporting means transports signals of said one type to said removing means on activation of such second transporting means.

16. The structure of claim 15, wherein said first and second signal transporting means respectively comprise first and second time-delay means.

17. The structure of claim 16, further comprising means for effecting explusion of pairs of successive articles from said path through the medium of said removing means.

18. The structure of claim 17, wherein said means for effecting expulsion comprises a coupling circuit having means for effecting transmission of pairs of successive signals to said removing means, and starter means for energizing said coupling circuit at the will of the operator.

19. The structure of claim 16, further comprising means for counting the number of removed articles and for terminating such removal when the number of removed articles matches a predetermined number.

20. The structure of claim 19, wherein signals of said one type are signals of said second type so that the articles which are removed at said third path section are satisfactory articles.

21. The structure of claim 16, wherein said first and second time-delay means comprise a common first delay unit and discrete second delay units arranged to receive signals from said first unit and to respectively transmit signals to said segregating and said removing means.

22. The structure of claim 21, wherein said first unit comprises a discrete signal-delaying portion for each of said testing devices, said testing devices having signal transmitting outputs and said signal-delaying portions having inputs connected with the outputs of the respective testing devices.

23. The structure of claim 22, wherein said second units have inputs and said signal-delaying portions have outputs, said selector means further comprising means for connecting the outputs of said signal-delaying portions with the inputs of said second units.

24. The structure of claim 16, wherein each of said time-delay means comprises at least one shift register.

25. The structure of claim 16, wherein said selector means further comprises a memory activatable by said activating means to transmit an output signal denoting the selected testing device, comparator means connected with said testing devices and with the output of said memory and arranged to transmit to said second time-delay means signals of the first type generated by the selected testing device, and means for blocking the transmission of signals of said first type from the selected testing device to said first time-delay means while said memory is actuated.

26. The structure of claim 25, wherein said selector means further comprises a counter arranged to count the number of articles which are removed at said third path section and to terminate the removal of articles at said third path section when the number of removed articles matches a predetermined number.

27. The structure of claim 25, wherein said selector means further comprises means for terminating the actuation of said memory after elapse of a predetermined interval of time to thereby terminate the removal of articles at said third path section.

28. The structure of claim 25, wherein said first time-delay means has two successive stages and further comprising means for effecting removal of pairs of successive articles at said third path section, including a coupling circuit having a second memory actuatable to transmit an output signal and means for transmitting signals from said stages to said removing means in response to said output signal.

29. The structure of claim 28, further comprising second selector means activatable to effect removal of satisfactory articles from said third path section and comprising a third memory actuatable to transmit an output signal and a counter actuatable by the output signal of said third memory to count the number of signals of the second type and to transmit such signals to said removing means.

30. The structure of claim 29, further comprising means for adjusting said counter so as to deactivate said third memory on detection of a predetermined number of signals of said second type.

31. The structure of claim 29, further comprising means for preventing actuation of other two of said memories on actuation of any one of said memories.

32. The structure of claim 14, further comprising an additional testing device adjacent to an additional section of said path upstream of said second and third sections and arranged to generate additional signals on detection of incomplete articles, said selector means including means for preventing removal at said third path section of those articles whose examination resulted in the generation of said additional signals.

33. The structure of claim 14, further comprising means for intercepting the articles which are removed at said third path section.

34. The structure of claim 14, wherein said conveying means includes rotary conveyors.

35. The structure of claim 14, wherein the number of said testing devices exceeds two.

36. The structure of claim 14, wherein said machine is a filter tipping machine and the articles are filter cigarettes.

* * * * *